US005897419A

United States Patent [19]

Suganuma

[11] Patent Number: 5,897,419

[45] **Date of Patent: *Apr. 27, 1999**

[54] MOVING MODEL DEVICE FOR USE IN A RACING GAME

[75] Inventor: Masanori Suganuma, Yokohama, Japan

[73] Assignee: Konami Co., Ltd., Hyogo-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/944,715

[22] Filed: Oct. 6, 1997

Related U.S. Application Data

[63] Continuation of application No. 08/661,263, Jun. 10, 1996, abandoned.

[30] Foreign Application Priority Data

Jun. 13, 1995 [JP] Japan ..... 7-169312

[51] Int. Cl.[6] ..... A63H 7/00; A63H 11/06

[52] U.S. Cl. ..... 446/285; 446/313; 446/135

[58] Field of Search ..... 463/67, 61, 62; 273/246, 461

[56] References Cited

U.S. PATENT DOCUMENTS

| | | | |
|---|---|---|---|
| 1,043,808 | 11/1912 | Denman | 446/313 |
| 1,647,507 | 11/1927 | Cross | 446/285 X |
| 2,218,065 | 10/1940 | Berger | 446/313 |
| 2,782,556 | 2/1957 | Otis | 446/292 |
| 3,118,247 | 1/1964 | Allen | 446/285 |
| 5,618,233 | 4/1997 | Iimura et al. | 446/285 X |

FOREIGN PATENT DOCUMENTS

| | | | |
|---|---|---|---|
| 516160 | 12/1992 | European Pat. Off. . | |
| 702988 | 3/1996 | European Pat. Off. . | |
| 85621 | of 1895 | Germany | 446/285 |
| 531044 | 12/1957 | Italy | 446/288 |
| H1-152698 | 10/1989 | Japan . | |
| 3009057 | 1/1995 | Japan . | |

*Primary Examiner*—Robert A. Hafer
*Assistant Examiner*—D. Neal Muir
*Attorney, Agent, or Firm*—Jordan & Hamburg

[57] ABSTRACT

A moving model device for use in a racing game machine having a racing field, the moving model device includes a base member provided with a rollable body rollable over the racing field, an animal model body disposed above the base member and a rotary shaft provided between the base member and the animal model. The rotary shaft is rotatable with the rollable body. The animal model body is provided with a motion conversion mechanism which converts a rotary motion of the rotary shaft into a reciprocating motion and an oscillating mechanism which swings the foreleg and hind leg members in accordance with the converted reciprocating motion.

47 Claims, 3 Drawing Sheets

MOVING MODEL DEVICE FOR USE IN A RACING GAME

This application is a continuation, of application Ser. No. 08/661,263 filed Jun. 10, 1996, now abandonded.

BACKGROUND OF THE INVENTION

The present invention relates generally to a moving model device constructed to run on a racing board of a racing game machine and, more particularly, to such a moving model device that comprises an animal model resembling a racehorse, for instance, mounted on a base member which can run on a mimic racetrack formed on a horse race game machine.

Moving model devices of this kind are disclosed in Japanese Unexamined Utility Model Publication No. 1-152698 and Japanese Utility Model Registration No. 3009057. These conventional moving model devices are essentially horse model devices, each comprising a miniature racehorse (hereinafter referred to as a horse model) mounted by an artificial human figure representing a jockey (hereinafter referred to as a jockey model), for use in a horse race game machine. In such a horse race game machine, a plurality of horse model devices compete in a race, running on a mimic racetrack resembling an actual race course in accordance with a specified algorithm, and individual players predict results of the race in advance and compete with each other for the correctness of their predictions.

In this type of horse race game machine, it is preferable to make each race resemble an actual horse race as closely as possible to give utmost reality to the players. From this point of view, the moving model devices described in the aforementioned Publications are so constructed that individual horse models swing their forelegs and hind legs individually while running on a mimic racetrack in order to reproduce realistic behavior of racehorses running on an actual racetrack.

More particularly, the moving model device disclosed in Japanese Unexamined Utility Model Publication No. 1-152698 comprises an animal model mounted on a base member which runs on a mimic racetrack, the animal model being linked to an axle provided in the base member via a crank mechanism. In this construction, the animal model and its legs are caused to swing when wheels of the base member rotate.

In Japanese Utility Model Registration No. 3009057, a model of a quadruped is supported on a moving base via a supporting rod. A rotary motion of an axle in the moving base is converted into a rotary motion of a rotary shaft which passes through the supporting rod. The rotary motion of the rotary shaft is further converted into a rotary motion of a shaft which is arranged parallel to the axle. As a result, an eccentric cam rotates, causing legs of the model to swing back and forth.

The aforementioned conventional moving model devices designed for use in racing game machines have however the following problems.

In the moving model device disclosed in Japanese Unexamined Utility Model Publication No. 1-152698, the crank mechanism for swinging the animal model and its legs is exposed to the players'0 view in addition to a mechanism for supporting the animal model on the base member. This is liable to impair realistic feelings of the players.

According to the construction of the moving model device disclosed in Japanese Utility Model Registration No. 3009057, the eccentric cam for swinging the legs of the animal model rotates in a main body of the animal model. It is therefore essential that the main body of the animal model has a sufficient internal space to accommodate the eccentric cam. Moreover, the eccentric cam should be large enough to ensure a sufficient swinging angle of the legs. This inevitably requires a considerable size of the main body of the animal model, resulting in deterioration of the animal model's external appearance and reality.

SUMMARY OF THE INVENTION

It is an object of the present invention to provide a moving model device which has overcome the aforementioned problems of the prior art.

It is an object of the invention to provide a moving model device which can provide actual racehorses featuring a well-proportioned and highly realistic external appearance.

According to the invention, a moving model device for use in a racing game machine having a racing field comprises: a base member provided with a rollable body rollable over the racing field; an animal model body disposed above the base member and including foreleg members and hind leg members, the foreleg and hind leg members being swingable about there respective pivots; a rotary shaft provided between the base member and the animal model, the rotary shaft being operatively connected with the rollable body and rotatable about an axis thereof in accordance with a rotation of the rollable body; a motion conversion mechanism which converts a rotary motion of the rotary shaft into a reciprocating motion; and an oscillating mechanism which swings the foreleg and hind leg members in accordance with the converted reciprocating motion.

In the moving model device thus constructed, the rotary shaft rotates when the base member travels on the racing field. The motion conversion mechanism converts this rotary motion into a reciprocating motion along the longitudinal axis of the animal model body. The oscillating mechanism causes the foreleg and hind leg members to swing in accordance with the reciprocating motion produced by the motion conversion mechanism. Therefore, the foreleg and hind leg members automatically swing when the moving model device runs on the racing field.

Motive power produced by the rollable body is transmitted to the animal model body by way of the rotary shaft and only the base member and animal model body are exposed to external view, without jeopardizing the reality of external appearance of the moving model device. Also, the animal model body can be constructed in a small physical size because the rotary motion of the rotary shaft is converted into a reciprocating motion by the motion conversion mechanism for swinging the foreleg and hind leg members. In addition, the above construction provides an increased degree of freedom in the design of the animal model body, ensuring a realistic appearance of the animal model body. Accordingly, the invention makes it possible provide moving model devices resembling actual racehorses featuring a well-proportioned and realistic external appearance.

The motion conversion mechanism may be preferably provided with a slider reciprocatingly slidable along longitudinal directions of the animal model body and a crankshaft connecting between the slider and the rotary shaft, one end of the crankshaft being secured at an off-centered position of the rotary shaft.

In this construction, the crankshaft causes the slider to reciprocally move in the back-and-forth directions of the animal model body when the rotary shaft rotates. In other words, the crankshaft converts the rotary motion of the rotary shaft into a reciprocating motion of the slider.

Further, the oscillating mechanism may be provided with a pivot shaft rotatably mounted on the animal model body and fixedly attached with a pair of foreleg members or hind leg members on both ends thereof and an oscillating cam member one end of which is fixedly connected with the pivot shaft and the other end of which is connected with the slider.

In this construction, the oscillating cam member linked to the slider swings together with the pivot shaft in accordance with the reciprocating motion of the slider. As a result, the foreleg or hind leg members, to which the oscillating cam member is attached, swings in accordance with movements of the oscillating cam member.

The animal model body may be provided with a swingable head member operatively connected with the oscillating cam member. Further, a jockey model may be swingably mounted on the animal model body. In this case, the jockey model is operatively connected with the head member.

In this construction, the head member is swung when the oscillating cam member swings. This will provide additional reality to movements of the moving model device. The mounting of the jockey model swingable rhythmically in accordance with movements of the head member will provide even higher reality to the moving model device.

These and other objects, features and advantages of the invention will become more apparent upon reading the following detailed description of a preferred embodiment which is illustrated in the appended drawings.

DETAILED DESCRIPTION OF THE PREFERRED EMBODIMENT OF THE INVENTION

A preferred embodiment of the invention is now described in detail with reference to the accompanying drawings.

Figure 1:
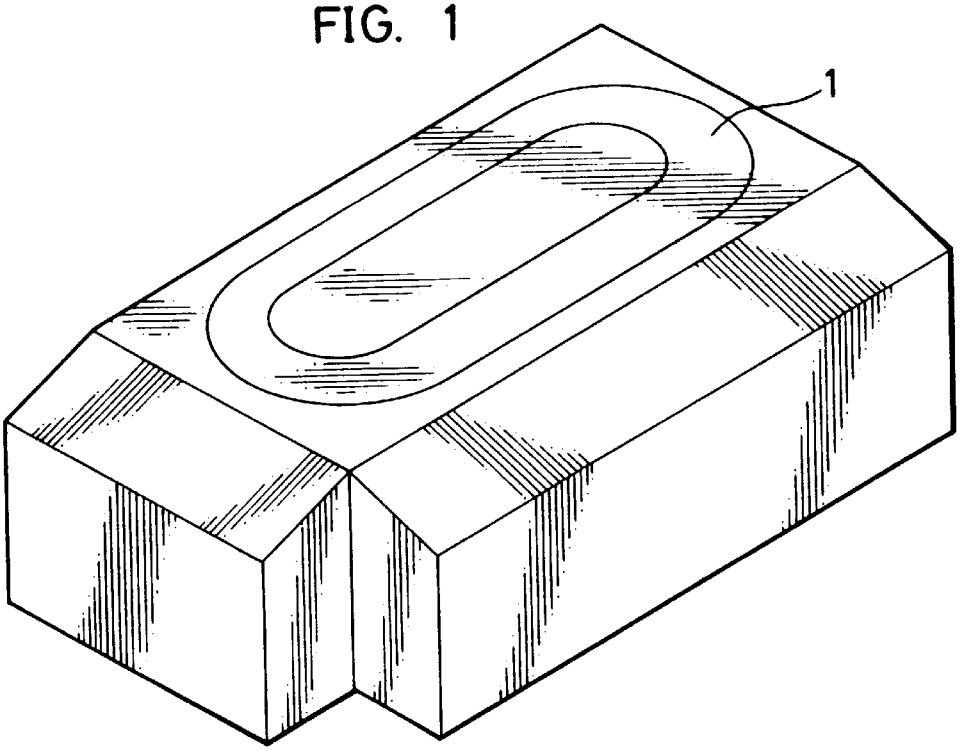
FIG. 1 is a perspective view of a horse race game machine adopting horse model devices according to the invention.

FIG. 1 is a perspective view of a horse race game machine employing horse model devices 2 according to the invention, in which designated by the numeral 1 is a mimic horse racing field having a flat, oval-shaped racetrack on top that resembles an actual horse race course. A plurality of horse model devices 2 (not shown in FIG. 1) of the embodiment are disposed on the top of the horse racing field 1, which is constructed in the shape of a flat panel having a specified thickness. There is provided a vehicle platform (unillustrated) just beneath the horse racing field 1 with a specified clearance from the bottom surface of the horse racing field 1. A plurality of guiding vehicles (unillustrated) corresponding to the individual horse model devices 2 are arranged on the vehicle platform.

Powered by an external source or a battery, for instance, the guiding vehicles run along their specified paths on the vehicle platform. Any appropriate means may be employed for running the guiding vehicles. As an example, there may be provided rails or other guide members on the vehicle platform for guiding the vehicles along desired paths. An alternative approach would be to provide a camera or other monitoring facility for recognizing current positions of the individual guiding vehicles and to transmit commands for controlling their moving directions by use of a radio link. There is attached a magnet to the top of each guiding vehicle while each horse model device 2 also has a magnet attached to its lower part. With this arrangement, each horse model device 2 runs on the horse racing field 1 following its corresponding guiding vehicle due to magnetic attraction between the two magnets.

Figure 2:
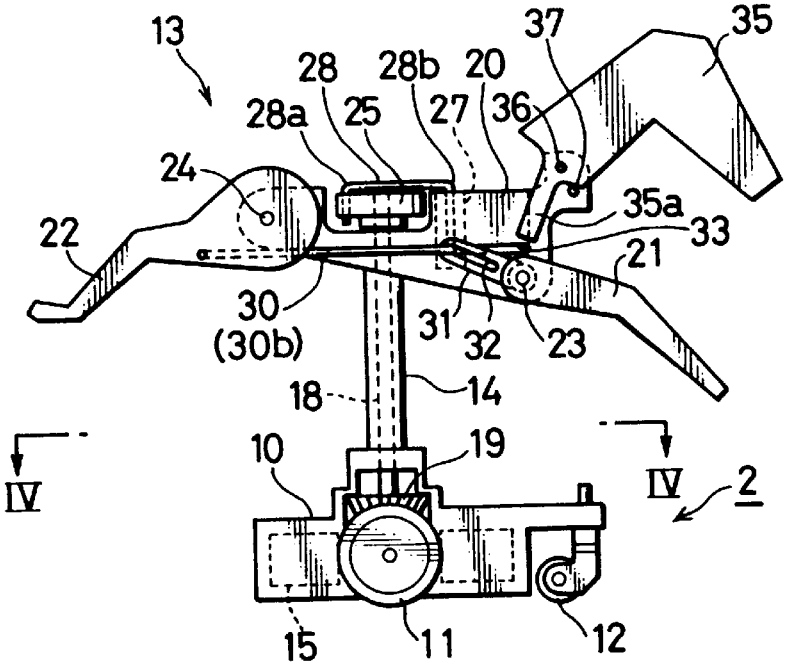
FIG. 2 is a diagrammatic elevational view showing a state of a horse model device of the invention.
Figure 3:
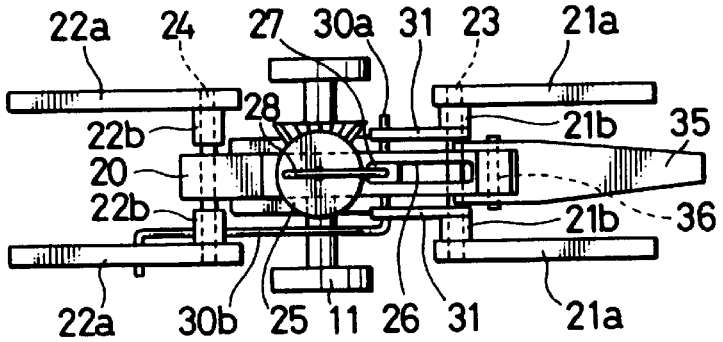
FIG. 3 is a top plan view showing a construction of the horse model device.
Figure 4:
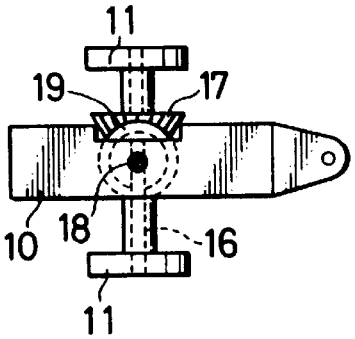
FIG. 4 is a sectional view taken along the line IV—IV in FIG. 2.
Figure 5:
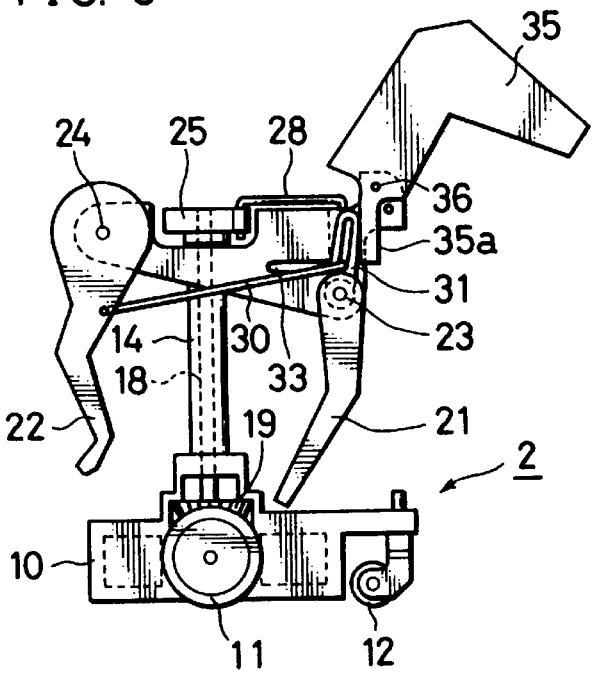
FIG. 5 is a diagrammatic elevational view showing another state of the horse model device.

FIG. 2 is a diagrammatic elevational view depicting an inventive horse model device 2; FIG. 3 is a plan view depicting a construction of the horse model device 2; FIG. 4 is a sectional view taken along the line IV—IV in FIG. 2; and FIG. 5 is a diagrammatic elevational view illustrating a state of the horse model device 2 of FIG. 2.

Referring to these figures, designated by the numeral 10 is a base member of the horse model device 2 placed on top of the horse racing field 1. Supported by a pair of wheels 11 and a caster 12 that turn around on the horse racing field 1, the base member 10 can freely move along the racetrack formed on the horse racing field 1. The numeral 13 indicates a horse model which is fixed to the top of a hollow upright bar 14. The horse model 13 will be discussed later in this detailed description of the preferred embodiment. In FIG. 2, the numeral 15 indicates a magnet provided at the bottom of the base member 10.

A bevel gear 17 is concentrically mounted on an axle 16, by which the wheels 11 are rotatably supported, as shown in FIG. 4. The upright bar 14 accommodates in its internal space a shaft 18 which is supported rotatably about its axis as shown in FIG. 2, and a bevel gear 19 which engages with the bevel gear 17 is mounted at a lower end of the shaft 18. In this construction, the wheels 11 rotate when the base member 10 moves on the horse racing field 1 and this rotary motion is conveyed to the shaft 18 by way of the bevel gears 17 and 19. Thus, the shaft 18 rotates about its own axis when the base member 10 travels.

The horse model 13 comprises a main body 20 fixed to the top of the upright bar 14 and pairs of foreleg members 21 and hind leg members 22 attached close to forward and rear ends of the main body 20, respectively. Each foreleg member 21 comprises a main foreleg portion 21*a* resembling a foreleg of an actual racehorse and a sleeve 21*b* provided at a shoulder joint position of the main foreleg portion 21*a*, as shown in FIG. 3. The pair of foreleg members 21 are swingably supported at a forward part of the main body 20, with their sleeves 21*b* firmly fitted to both ends of a pivot shaft 23 which extends laterally through the forward part of the main body 20. Similarly, each hind leg member 22 comprises a main hind leg portion 22*a* resembling a hind leg of an actual racehorse and a sleeve 22*b* provided at a hip joint position of the main hind leg portion 22*a*. The pair of hind leg members 22 are swingably supported at a rear part of the main body 20, with their sleeves 22*b* firmly fitted to both ends of a pivot shaft 24 which extends laterally through the rear part of the main body 20.

A vertical through hole (unillustrated) is made at a middle position of the main body 20 of the horse model 13 and an upper end portion of the shaft 18 is fitted into this through hole. A circular, rotary disc 25 is concentrically fitted to the upper end of the shaft 18. There is formed a groove 26 in a frontal part of the main body 20 extending along its longitudinal axis, and a slider 27 is slidably fitted into the groove 26, as shown in FIG. 3. Designated by the numeral 28 is a wirelike, inverted J-shaped connecting rod. One end 28*a* of the connecting rod 28 is rotatably fitted to the rotary disc 25 at its off-centered position while the other end 28*b* of the connecting rod 28 is rotatably fitted to the slider 27, as shown in FIGS. 2 and 3. Given this construction, when the rotary disc 25 rotates together with the shaft 18, the connecting rod 28 functions as a crankshaft which converts the rotary motion of the rotary disc 25 into a reciprocating motion, causing the slider 27 to move back and forth in the groove 26 along the longitudinal axis of the main body 20.

Designated by the numeral 30 is a wirelike connecting rod similar to the connecting rod 28. As shown most clearly in FIG. 3, the connecting rod 30 has a straight front portion 30*a* which passes through a horizontal hole in the slider 27 in a lateral direction (vertical direction in FIG. 3) and extends to both sides of the main body 20 as well as a connecting portion 30*b* which extends backward (leftward in FIG. 3) along the longitudinal axis of the main body 20 from one end of the front portion 30*a*. The rear end of the connecting portion 30*b* of the connecting rod 30 is swingably connected to one of the main hind leg portions 22*a* (the main hind leg portion 22*a* of the right hind leg member 22 in the example of FIG. 3).

Designated by the numeral 31 are oscillating cam members individually fitted to the sleeves 21*b* of the foreleg members 21. The oscillating cam members 31 extend radially from the respective sleeves 21*b*. Each oscillating cam member 31 has a cam groove 32 formed along its long axis, and the front portion 30*a* of the connecting rod 30 passes through the cam grooves 32 of both the right and left oscillating cam members 31.

In the horse model device 2 thus constructed, when the slider 27 moves back and forth along the groove 26 as a result of the rotary motion of the rotary disc 25, the connecting rod 30 of which front portion 30*a* passes through the slider 27 also moves back and forth. As a result, the hind leg members 22 mechanically linked to the rear end of the connecting rod 30 swing about the pivot shaft 24 within a specified angle, as shown in FIGS. 2 and 5. The back-and-forth motion of the slider 27 also causes the front portion 30*a* of the connecting rod 30 to slide along the cam grooves 32. Accordingly, the foreleg members 21 linked to the oscillating cam members 31 swing about the pivot shaft 23 within a specified angle, as shown in FIGS. 2 and 5. The oscillating cam members 31, connecting rod 30 and associated elements are arranged in such a manner that the foreleg members 21 and hind leg members 22 swing in approximately opposite directions. This allows the foreleg members 21 and hind leg members 22 to reproduce natural movements of an actual racehorse.

As shown most clearly in FIG. 5, the main body 20 has a slot 33 extending in the longitudinal directions of the main body 20, and the front portion 30*a* of the connecting rod 30 which reciprocates in the same longitudinal directions passes through this slot 33, extending to both sides of the main body 20.

Designated by the numeral 35 is a head member of the horse model 13. Formed in the shape of a racehorse, the head member 35 is attached swingably about a pivot 36 which is fitted to an upper front part of the main body 20. Since the center of gravity of the head member 35 is located to the front of the pivot 36, there arises a moment of force which gives the head member 35 a tendency to turn clockwise, as illustrated in FIG. 2. For this reason, there is provided a stopper 37 to the front of the pivot 36 and the head member 35 is normally set in a position shown in FIG. 2 as a lower part of the head member 35 comes into contact with the stopper 37 in this position. A lower stemlike portion 35*a* of the head member 35 extends down to a swinging area of one of the oscillating cam members 31. When the foreleg members 21 swing in the clockwise direction, the oscillating cam member 31 presses against the lower stemlike portion 35*a* of the head member 35 so that the head member 35 is caused to swing in the counterclockwise direction, as illustrated in FIG. 5.

Figure 6:
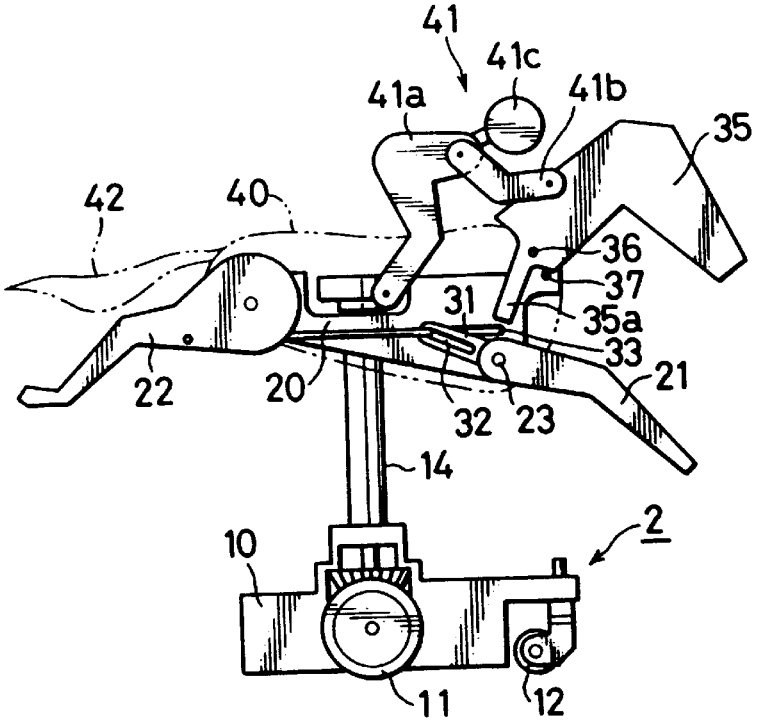
FIG. 6 is a diagrammatic elevational view showing a state of the horse model device fitted with a trunk cover and a jockey model.
Figure 7:
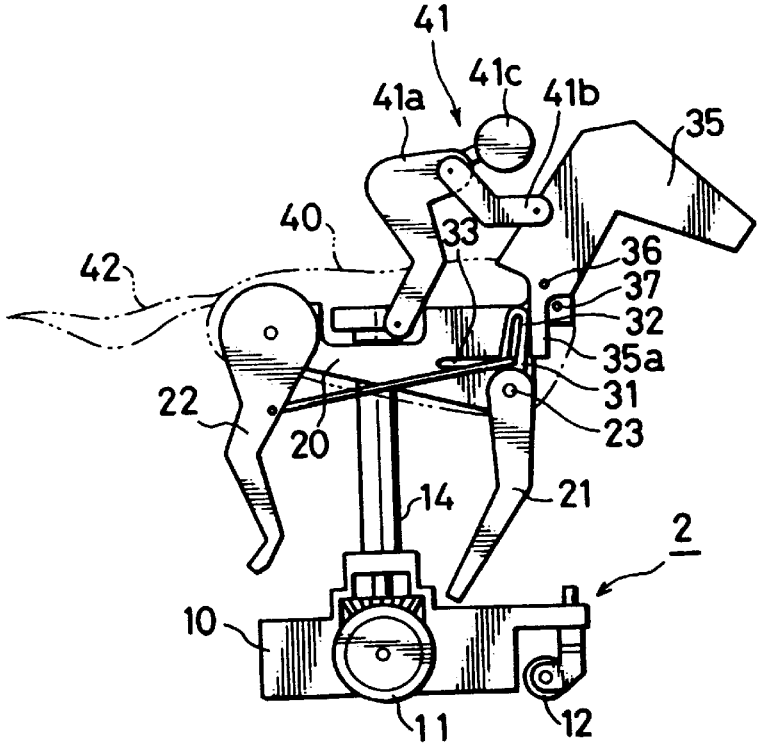
FIG. 7 is a diagrammatic elevational view showing another state of the horse model device fitted with the trunk cover and the jockey model.

FIG. 6 is a diagrammatic elevational view showing a state of the horse model device fitted with a trunk cover 40 and a jockey model 41 while FIG. 7 is a diagrammatic elevational view showing another state of the horse model device 2 fitted with the trunk cover 40 and the jockey model 41.

Referring to FIGS. 6 and 7, the trunk cover 40 is a hollow covering formed in the shape of the trunk of a racehorse that is fitted between the main body 20 and the main foreleg and hind leg portions 21*a*, 22*a* of the horse model 13. The trunk cover 40 is fixed to the main body 20 of the horse model 13. The jockey model 41 comprises a main body 41*a* formed in the shape of a human body including leg members, an arm portion 41*b* formed in the shape of human arms and a head member 41*c* resembling a human head. The main body 41*a* is swingably fixed at its lower position to the trunk cover 40 and the arm portion 41*b* is swingably connected at its foremost position to the head member 35 of the horse model 13. Further, the jockey model 41 is linked to a shoulder joint position of the main body 41*a* of the jockey model 41 and the head member 41*c* is attached to the main body 41*a*. In this construction, the up-and-down motion of the head member 35 of the horse model 13 produces a back-and-forth motion of the arm portion 41*b*, and this causes the main body 41*a* of the jockey model 41 to swing within a specified angle, as shown in FIGS. 6 and 7. Incidentally, designated by the numeral 42 is a tail portion resembling an actual racehorse tail that is attached to a rear end (left end in FIG. 6) of the trunk cover 40.

The wheels 11 which are kept in contact with the racetrack formed on the horse racing field 1 rotate when the above-described horse model device 2 travels following its corresponding guiding vehicle due to magnetic attraction between the magnet of the guiding vehicle and the magnet 15 of the horse model device 2. This causes the axle 16 and bevel gear 17 to rotate in the same direction as the wheels 11. As the bevel gear 19 meshed with the bevel gear 17 rotates, the shaft 18 rotates about its own axis inside the upright bar 14 so that the rotary disc 25 mounted at the top of the shaft 18 turns in the same direction.

The connecting rod 28 converts the rotary motion of the rotary disc 25 into a reciprocating motion of the slider 27, causing it to slide back and forth in the groove 26 along the longitudinal axis of the main body 20 of the horse model 13. As the front portion 30*a* of the connecting rod 30 is fitted in the horizontal hole formed in the slider 27, the connecting rod 30 also moves back and forth in the longitudinal directions of the main body 20. This back-and-forth motion causes the connecting rod 30 to slide in the cam grooves 32 of the oscillating cam members 31. Consequently, the oscillating cam members 31 swing about the pivot shaft 23 so that both the right and left foreleg members 21 linked to the oscillating cam members 31 swing about the pivot shaft 23. The reciprocating motion of the connecting rod 30 also causes the hind leg members 22 which is mechanically linked to the rear end of the connecting rod 30 to swing at the same time.

The reciprocating motion of the connecting rod 30 causes a swinging motion of the oscillating cam members 31. When the connecting rod 30 moves forward, one of the oscillating cam members 31 presses against the lower stem-like portion 35*a* of the head member 35 of the horse model 13, causing the head member 35 to swing in the counterclockwise direction, as illustrated in FIG. 5. As the arm portion 41*b* of the jockey model 41 is joined to the head member 35 of the horse model 13, the swinging motion of the head member 35 causes the arm portion 41*b* to move back and forth, consequently moving the main body 41*a* of the jockey model 41 back and forth.

As will be understood from the foregoing discussion, and especially from the illustrations in FIGS. 2, 5, 6 and 7, the foreleg members 21, hind leg members 22 and head member 35 of the horse model 13 produce as a whole a naturally interlocked swinging motion resembling the movements of an actual racehorse. In addition, the jockey model 41 produces realistic movements of a human jockey competing in a horse race.

Motive power produced by the wheels 11 is transmitted to the horse model 13 by the shaft 18 which is accommodated in the upright bar 14, and only the base member 10 and horse model 13 are exposed to external view. Therefore, the horse model 13 of the above-described embodiment does not impair players' realistic feelings unlike the earlier described conventional construction of which swinging mechanism is exposed. According to the embodiment of the invention, the main body of each animal model can be constructed in a smaller size compared to the conventional construction, in which individual leg members are swung by means of an eccentric cam. In addition, the invention provides an increased degree of freedom in the design of the main body of an animal model, making it possible to give a realistic appearance to each horse model device 2. This is the result of the construction of the invention, in which the rotary motion of the shaft 18 is converted into a reciprocating motion of the slider 27 and this reciprocating motion causes the foreleg members 21 and hind leg members 22 to swing back and forth.

As already mentioned, the rotary motion of the axle 16 is converted into a reciprocating motion of the slider 27 via the shaft 18, rotary disc 25 and connecting rod 28 and the reciprocating motion of the slider 27 causes the foreleg members 21 and hind leg members 22 to swing back and forth in this embodiment, whereas a rotating force of wheels is converted into a swinging force by a crank mechanism and this swinging force is further transmitted by way of another crank mechanism to cause an animal model's foreleg members and hind leg members to swing in the conventional construction. This gives the aforementioned mechanism of the embodiment an additional advantage over the conventional construction. Specifically, the mechanism of the embodiment for producing the swinging motion of the horse model 13 is subjected to a smaller load and a resisting force acting on the axle 16 of the base member 10 is less likely to occur compared to the conventional construction so that the horse model device 2 can travel smoothly.

While the invention has thus far been described with reference to its preferred embodiment, it should be apparent to those skilled in the art that such description is only illustrative, and various modifications may be made without departing from the sprit and scope of the invention. As an-example, although the individual moving model devices are guided by their corresponding guiding vehicles without any physical contact therebetween by means of magnetic attraction in the foregoing embodiment, a chain mechanism may be used, instead of the magnets, to directly drive the individual moving model devices. Furthermore, although the right and left foreleg members 21 swing together in a synchronized rotational motion as do the right and left hind leg members 22 in the above embodiment, a modification is possible to cause the right and left foreleg members 21, or hind leg members 22, to swing with a small phase difference by changing positions of the oscillating cam members 31, for instance, to give enhanced reality to their movements.

What is claimed is:

1. A moving model device for use in a racing game machine in which the moving model device moves along a Path of travel on a racing field, the moving model device comprising:

a base member provided with a rollable body rollable over the racing field;

an animal model body disposed above the base member, said animal model body having a longitudinal axis generally parallel to said path of travel;

foreleg members and hind leg members;

pivot means pivotally mounting the foreleg members and the hind leg members on said animal model body for pivotal movement relative to the animal model body;

a rotary shaft provided between the base member and the animal model body, the rotary shaft being operatively connected with the rollable body and rotatable about an axis thereof in accordance with a rotation of the rollable body;

a motion conversion mechanism operatively connected to said rotary shaft to convert a rotary motion of the rotary shaft into a linear reciprocating motion which is generally parallel to said longitudinal axis; and an oscillating mechanism which is operatively connected to said motion conversion mechanism and to said foreleg and hind leg members to pivot the foreleg and hind leg members about said pivot means in accordance with the converted linear reciprocating motion.

2. A moving model device according to claim 1, wherein said linear reciprocating motion is a motion which traverses a longitudinal linear direction, said motion conversion mechanism including a slider reciprocatingly slidable in said longitudinal linear direction and a crankshaft connected between the slider and the rotary shaft, one end of the crankshaft being secured at an off-centered position of the rotary shaft.

3. A moving model device according to claim 2, wherein the pivot means includes a pivot shaft rotatably mounted on the animal model body and fixedly attached with one of said foreleg members or hind leg members on an end of said one of said foreleg members or hind leg members, the oscillating mechanism including an oscillating cam member having one end fixedly connected with the pivot shaft and the other end connected with the slider.

4. A moving model device according to claim 3, wherein the animal model body includes a swingable head member operatively connected with the oscillating cam member.

5. A moving model device according to claim 4, further comprising a jockey model swingably mounted on the animal model being body, the jockey model operatively connected with the head member.

6. A moving model device for use in a racing game machine comprising:

an animal model body movable along a path of travel and having a longitudinal axis generally parallel to said path of travel;

foreleg members and hind leg members;

pivot means pivotally mounting the foreleg members and the hind leg members on said animal model body for pivotal movement relative to the animal model body;

a rotary shaft on said animal model body;

a motion conversion mechanism operatively connected to said rotary shaft to convert a rotary motion of the rotary shaft into a linear reciprocating motion which is generally parallel to said longitudinal axis of said animal model body; and an oscillating mechanism operatively connected to said motion conversion mechanism and to said foreleg and hind leg members to pivot the foreleg and hind leg members about said pivot means in accordance with the linear reciprocating motion.

7. A moving model device according to claim 6 wherein said oscillating mechanism includes a slider movable on said animal model body in accordance with said linear reciprocating motion, said oscillating mechanism operatively connecting the slider to the foreleg and hind leg members to pivot the foreleg and hind leg members about said pivot means as said slider reciprocates in accordance with said linear reciprocating motion.

8. A moving model device according to claim 7 wherein said animal model body has an elongated linear groove, said slider being reciprocable slidable in said groove.

9. A moving model device according to claim 8 wherein said elongated linear groove has an elongate axis generally parallel to said longitudinal axis of said animal model body.

10. A moving model device according to claim 7 wherein said oscillating mechanism includes a connecting rod driven by said slider and connected to said foreleg and hind leg members for pivoting said foreleg and hind leg members about said pivot means.

11. A moving model device according to claim 7 wherein said oscillating mechanism includes a connecting rod connected to said slider, said connecting rod being operatively connected to the foreleg and hind leg members to pivot the foreleg and hind leg members about said pivot means as said slider reciprocates in accordance with said linear reciprocating motion.

12. A moving model device according to claim 11 wherein said connecting rod has two generally mutually perpendicular rod portions, one of said rod portions being pivotally connected to said slider and being operatively connected to one of said foreleg and hind leg members, the other of said rod portions being operably connected to the other of said foreleg and hind leg members.

13. A moving model device according to claim 12 wherein said animal model body has an elongated slot, said one rod portion of said connecting rod being slidably disposed in said elongated slot.

14. A moving model device according to claim 13 wherein said animal model body has an elongated linear groove, said linear groove having a first elongate axis generally parallel to said longitudinal axis of said animal model body, said slider being reciprocally slidable in said groove, said elongated slot having a second elongate axis generally parallel to said first elongate axis.

15. A moving model device according to claim 6 wherein said oscillating mechanism comprises a connecting rod and a cam fixed to one of said foreleg and hind leg members, said connecting rod being operatively connected to said cam for pivoting said one of said foreleg and hind leg members about the pivot means which pivotably supports said one of said foreleg and hind leg members on said animal model body.

16. A moving model device according to claim 15 wherein said cam includes a cam part having an elongated cam groove, said connecting rod having an actuating part movably disposed in said cam groove.

17. A moving model device according to claim 16 wherein said elongated cam groove has an elongate axis, said actuating part of said connecting rod transversing back and forth in said cam groove as said one of said foreleg and hind leg members oscillates about said pivot means.

18. A moving model device according to claim 17 wherein said animal model body has an elongated slot, said actuating part of said connecting rod transversing back and forth in said elongated slot as said one of said foreleg and hind leg members oscillates about said pivot means.

19. A moving model device according to claim 18 wherein said elongated slot has an elongate axis generally parallel to said longitudinal axis of said animal model body, said actuating part of said connecting rod moving in a linear path when transversing back and forth in said elongated slot.

20. A moving model device according to claim 16 wherein said oscillating mechanism includes a reciprocable slider slidable on said animal model body along a linear path generally parallel to said longitudinal axis of said animal model body, said actuating part of said connecting rod being operatively connected to said slider.

21. A moving model device according to claim 20 wherein said actuating part of said connecting rod is pivotably connected to said slider.

22. A moving model device according to claim 21 wherein said connecting rod has a second part generally perpendicular to said actuating part, said pivot means pivotally connecting said second part of said connecting rod to the other of said foreleg and hind leg members.

23. A moving model device according to claim 15 further comprising a pivot connection pivotally connecting said connecting rod to the other of said foreleg and hind leg members, said pivot connection being spaced from the pivot means which pivotally connects the other of said foreleg and hind leg members to said animal model body.

24. A moving model device according to claim 6 wherein said oscillating mechanism includes a cam fixed to one of said foreleg and hind leg members, said cam and said one of said foreleg and hind leg members being generally diametrically disposed on opposite sides of said pivot means which pivotally supports said one of said foreleg and hind leg members on said animal model body.

25. A moving model device according to claim 6 further comprising a head member pivotably mounted on said animal model body, said head member having an engageable part, said oscillating mechanism having an engaging part operable to engage said engageable part of said head member to effect pivoting of said head member in one pivotal direction, said engaging part being disengaged from said engageable part to permit said head member to pivot in a pivotal direction opposite to said one pivotal direction.

26. A moving model device according to claim 25 further comprising a jockey model pivotally connected to said animal model body and to said head member such that said pivoting of said head member effects pivoting of said jockey model in said one pivotal direction.

27. A moving model device according to claim 26 wherein said jockey model includes a jockey model body portion and a jockey model arm portion, said jockey model body portion being pivotably connected to said animal model body by a first pivot connection, said jockey model body portion being pivotally connected to said jockey model arm portion by a second pivotal connection, said jockey model arm portion being pivotably connected to said head member by a third pivotal connection, and said head member being pivotally connected to said animal model body by a fourth pivotal connection, said first pivot connection having a first pivot axis which remains in a fixed position relative to the animal model body as said jockey model is pivoted.

28. A moving model device according to claim 27 wherein said animal model body includes a main animal body part and a trunk cover fixed to said main animal body part, said first pivotal connection pivotally connecting said jockey model body portion to said trunk cover, said fourth pivotal connection pivotally connecting said head member to said main animal body part.

29. A moving model device according to claim 6 wherein said oscillating mechanism includes a cam fixed to one of said foreleg and hind leg members and a connecting rod operatively connected to said cam and to the other of said foreleg and hind leg members for pivoting said foreleg and hind leg members about the pivot means, a head member pivotably mounted on said animal model body, said head member having an engageable part, said cam being operable to engage said engageable part of said head member to effect pivoting of said head member in one pivotal direction, said cam being disengaged from said engageable part to permit said head member to pivot in a pivotal direction opposite to said one pivotal direction.

30. A moving model device comprising:

an animal model body having a linear groove;

foreleg members and hind leg members;

pivot means pivotally mounting the foreleg members and the hind leg members on said animal model body for pivotal movement relative to the animal model body;

a rotary shaft on said animal model body;

a motion conversion mechanism operatively connected to said rotary shaft to convert a rotary motion of the rotary shaft into a reciprocating linear motion; and an oscillating mechanism which is operatively connected to said motion conversion mechanism and to said foreleg and hind leg members, said oscillating mechanism further including a slider reciprocal linearly in said linear groove in said animal model body, said slider being operatively connected to the foreleg and hind leg members to pivot the foreleg and hind leg members about said pivot means as said slider reciprocates linearly in said linear groove.

31. A moving model device for use in a racing game machine comprising:

an animal model body;

foreleg members and hind leg members;

pivot means pivotally mounting the foreleg members and the hind leg members on said animal model body for pivotal movement relative to the animal model body;

a rotary shaft on said animal model body;

a motion conversion mechanism operatively connected to said rotary shaft to convert a rotary motion of the rotary shaft into a linear reciprocating motion; and an oscillating mechanism operatively connected to said motion conversion mechanism and to said foreleg and hind leg members, said oscillating mechanism further including a cam fixed to one of said foreleg and hind leg members and a connecting rod operatively connected to said cam and to the other of said foreleg and hind leg members for pivoting said foreleg and hind leg members about the pivot means.

32. A moving model device for use in a racing game machine having a racing field, the moving model device comprising:

a base member provided with a rollable body tollable over the racing field;

an animal model body disposed above the base member;

foreleg members and hind leg members;

pivot means pivotally mounting the foreleg members and the hind leg members on said animal model body for pivotal movement relative to the animal model body;

a rotary shaft provided between the base member and the animal model body, the rotary shaft being operatively connected with the rollable body and rotatable about an axis thereof in accordance with a rotation of the rollable body;

a motion conversion mechanism which converts a rotary motion of the rotary shaft into a linear reciprocating motion; and an oscillating mechanism which is operatively connected to said motion conversion mechanism and which pivots the foreleg and hind leg members about said pivot means in accordance with the converted linear reciprocating motion, said oscillating mechanism pivoting said foreleg members in one rotary direction while pivoting said hind leg members in an opposite rotary direction.

33. A moving model device for use in a racing game machine having a racing field, the moving model device comprising:

a base member provided with a rollable body rollable over the racing field;

an animal model body disposed above the base member;

foreleg members and hind leg members;

pivot means pivotally mounting the foreleg members and the hind leg members on said animal model body for pivotal movement relative to the animal model body;

a rotary shaft provided between the base member and the animal model body, the rotary shaft being operatively connected with the rollable body and rotatable about an axis thereof in accordance with a rotation of the rollable body;

a motion conversion mechanism which converts a rotary motion of the rotary shaft into a linear reciprocating motion; and an oscillating mechanism which is operatively connected to said motion conversion mechanism and which pivots the foreleg and hind leg members about said pivot means in accordance with the converted linear reciprocating motion, said oscillating mechanism including a reciprocating slider reciprocable along a linear path, one of said pair of leg members having a cam, said oscillating mechanism further including a rod member between said cam and the other pair of leg members, said rod member being connected to said reciprocating slider, said reciprocating slider reciprocating in a first linear direction and a second linear direction opposite to said first linear direction, said reciprocating slider when reciprocating in said first linear direction causing said one pair of leg members to pivot about its respective pivot means in a first rotary direction, said slider when reciprocating in said first direction causing said other pair of leg members to pivot about its respective pivot means in a second rotary direction opposite to said first rotary direction.

34. A moving model device according to claim 33 wherein said reciprocating slider when reciprocating in said second linear direction causes said one pair of leg members to pivot about its respective pivot means in said second rotary direction, said slider when reciprocating in said second linear direction causing said other pair of leg members to pivot about its respective pivot means in said first rotary direction.

35. A moving model device comprising:

an animal model body;

foreleg members and hind leg members;

pivot means pivotally mounting the foreleg members and the hind leg members on said animal model body for pivotal movement relative to the animal model body;

a rotary shaft rotatably mounted on the animal model body;

a motion conversion mechanism which converts a rotary motion of the rotary shaft into a linear reciprocating motion; and an oscillating mechanism which is operatively connected to said motion conversion mechanism and which pivots the foreleg and hind leg members about said pivot means in accordance with the converted linear reciprocating motion.

36. A moving model device according to claim 35 wherein said oscillating mechanism includes a slider slidable in a linear direction, said motion conversion mechanism including a rotary disk driven by said rotary shaft, and a connecting rod having one end portion rotatably fitted to said disk at an off-center position of the disk and an opposite end portion rotatably fitted to said slider.

37. A moving model device according to claim 35 wherein said oscillating mechanism includes a cam fixed to move with one pair of said leg members, said one pair of leg members extending from its respective pivot means in one direction, said cam extending from the last said pivot means in a direction opposite to said one direction, said one pair of leg members and said cam being pivotal together about the last said pivot means in a first pivotal direction and in a second pivotal direction opposite to said one pivotal direction.

38. A moving model device according to claim 37 wherein the motion conversion mechanism includes a reciprocal slider slidable along a linear path, said cam having an elongated slot, said oscillating mechanism further including a rod slidable in said slot, said rod being connected to said slider.

39. A moving model device according to claim 38 wherein said rod is rotatably connected to the other pair of leg members.

40. A moving model device according to claim 36 further comprising a head member pivotally mounted on said animal body member, said cam when moving in said one pivotal direction being operable to engage said head member and pivot said head member relative to said animal body member.

41. A moving model device according to claim 40 wherein said head member is pivotally mounted on said animal body member such that the weight of the head member tends to maintain said head member in a predetermined pivotal position on said animal body member, said cam member when moving in said one pivotal direction being operable to engage said head member and pivot said head member from said predetermined position.

42. A moving model device comprising;

an animal model body, said animal body model having an elongated slot having an elongate axis which is generally horizontally disposed;

foreleg members and hind leg members;

pivot means pivotally mounting the foreleg members and the hind leg members on said animal model body for pivotal movement relative to the animal model body;

a rotary shaft rotatably mounted on the animal model body;

a motion conversion mechanism which converts a rotary motion of the rotary shaft into a linear reciprocating motion, said motion conversion mechanism including a rotary disk driven by said rotary shaft, said rotary disk being rotatable about a generally vertical axis; and an oscillating mechanism which is operatively connected to said motion conversion mechanism and which pivots the foreleg and hind leg members about said pivot means in accordance with the converted linear reciprocating motion, said oscillating mechanism including a slider slidable in a linear direction, said slider being slidable in said elongated slot.

43. A moving model device comprising;

an animal model body;

foreleg members and hind leg members;

pivot means pivotally mounting the foreleg members and the hind leg members on said animal model body for pivotal movement relative to the animal model body;

a rotary shaft rotatably mounted on the animal model body;

a motion conversion mechanism which converts a rotary motion of the rotary shaft into a linear reciprocating motion, said motion conversion mechanism including a reciprocal slider slidable along a linear path;

an oscillating mechanism which is operatively connected to said motion conversion mechanism and which pivots the foreleg and hind leg members about said pivot means in accordance with the converted linear reciprocating motion;

said oscillating mechanism including a cam fixed to move with one pair of said leg members, said cam having a first elongated slot, said one pair of leg members extending from its respective pivot means in one direction, said cam extending from the last said pivot means in a direction opposite to said one direction, said one pair of leg members and said cam being pivotal together about the last said pivot means in a first pivotal direction and in a second pivotal direction opposite to said one pivotal direction;

said oscillating mechanism further including a rod having an end portion slidable in said first elongated slot, said rod being connected to said slider, said animal body member having a second elongated slot, said rod having another end portion slidable in said second elongated slot.

44. A moving model device comprising:

an animal model body;

foreleg members and hind leg members;

pivot means pivotally mounting the foreleg members and the hind leg members on said animal model body for pivotal movement relative to the animal model body;

a rotary shaft rotatably mounted on the animal model body;

a motion conversion mechanism which converts a rotary motion of the rotary shaft into a linear reciprocating motion, said motion conversion mechanism including a rotary disk driven by said rotary shaft, said rotary disk being rotatable about a generally vertical axis; and an oscillating mechanism which is operatively connected to said motion conversion mechanism and which pivots the foreleg and hind leg members about said pivot means in accordance with the converted linear reciprocating motion.

45. A moving model device according to claim 44 wherein said oscillating mechanism includes a slider slidable in a linear direction, and a connecting rod having one end portion rotatably fitted to said rotary disk at an off-center position of the rotary disk and an opposite end portion rotatably fitted to said slider.

46. A moving model device according to claim 45 wherein said animal body model has an elongated slot having an elongate axis which is generally horizontally disposed, said slider being slidable in said elongated slot.

47. A moving model device according to claim 44 wherein said animal body has a first elongated slot, said oscillating mechanism including a slider slidable in said first elongated slot, a first connecting rod having one portion rotatably fitted to said rotary disk and another portion rotatably fitted to said slider, a second connecting rod connected between said slider and at least one of said foreleg and hind leg members, said animal body having a second elongated slot, said second connecting rod being slidable in said second elongated slot.

* * * * *